US011965225B2

(12) United States Patent
Jung et al.

(10) Patent No.: US 11,965,225 B2
(45) Date of Patent: Apr. 23, 2024

(54) STEEL SHEET HAVING EXCELLENT TOUGHNESS, DUCTILITY AND STRENGTH, AND MANUFACTURING METHOD THEREOF

(71) Applicant: ArcelorMittal, Luxembourg (LU)

(72) Inventors: Coralie Jung, Racrange (FR); Astrid Perlade, Le Ban-Saint-Martin (FR); Kangying Zhu, Metz (FR); Frédéric Kegel, Yutz (FR)

(73) Assignee: ARCELORMITTAL, Luxembourg (LU)

( * ) Notice: Subject to any disclaimer, the term of this patent is extended or adjusted under 35 U.S.C. 154(b) by 0 days.

(21) Appl. No.: 18/097,492

(22) Filed: Jan. 16, 2023

(65) Prior Publication Data

US 2023/0151452 A1 May 18, 2023

Related U.S. Application Data

(62) Division of application No. 16/956,390, filed as application No. PCT/IB2018/060242 on Dec. 18, 2018, now Pat. No. 11,591,665.

(30) Foreign Application Priority Data

Dec. 19, 2017 (FR) ..... 2017058129

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0226* (2013.01); *C21D 8/0236* (2013.01);
(Continued)

(58) Field of Classification Search
CPC ..... C21D 9/46; C21D 8/0226; C21D 8/0236; C21D 8/0263; C21D 8/0273;
(Continued)

(56) References Cited

U.S. PATENT DOCUMENTS 6,743,307 B1 6/2004 Engl et al.
10,272,514 B2 4/2019 Perlade et al.
(Continued)

FOREIGN PATENT DOCUMENTS

CN 105408513 A 3/2016
CN 107109571 A 8/2017
(Continued)

*Primary Examiner* — Anthony M Liang
*Assistant Examiner* — Danny N Kang
(74) *Attorney, Agent, or Firm* — Davidson, Davidson & Kappel, LLC

(57) ABSTRACT

A cold-rolled and heat treated steel sheet, has a composition comprising 0.1%≤C≤0.4%, 3.5%≤Mn≤8.0%, 0.1%≤Si≤1.5%, Al≤3%, Mo≤0.5%, Cr≤1%, Nb≤0.1%, Ti≤0.1%, V≤0.2%, B≤0.004%, 0.002%≤N≤0.013%, S≤0.003%, P≤0.015%. The structure consists of, in surface fraction: between 8 and 50% of retained austenite, at most 80% of intercritical ferrite, the ferrite grains, if any, having an average size of at most 1.5 μm, and at most 1% of cementite, the cementite particles having an average size lower than 50 nm, martensite and/or bainite.

13 Claims, 2 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/32*** | (2006.01) |
| ***C23C 2/06*** | (2006.01) |
| ***C23C 2/12*** | (2006.01) |

(52) U.S. Cl.
CPC ..... *C21D 8/0263* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/32* (2013.01); *C23C 2/06* (2013.01); *C23C 2/12* (2013.01); *C21D 2211/001* (2013.01); *C21D 2211/003* (2013.01); *C21D 2211/005* (2013.01); *C21D 2211/008* (2013.01)

(58) Field of Classification Search
CPC ..... C21D 2211/001; C21D 2211/003; C21D 2211/005; C21D 2211/008; C21D 8/0268; C22C 38/001; C22C 38/002; C22C 38/02; C22C 38/04; C22C 38/06; C22C 38/12; C22C 38/32; C22C 38/14; C22C 38/18; C22C 38/00; C22C 38/38; C22C 38/24; C22C 38/26; C22C 38/28; C22C 38/40; C22C 38/58; C23C 2/06; C23C 2/12
See application file for complete search history.

(56) References Cited

U.S. PATENT DOCUMENTS

| | | | |
|---|---|---|---|
| 2014/0230971 | A1 | 8/2014 | Kawasaki et al. |
| 2016/0167157 | A1 | 6/2016 | Perlade et al. |
| 2016/0340761 | A1 | 11/2016 | Garza-Martinez et al. |
| 2018/0030564 | A1 | 2/2018 | Hasegawa et al. |
| 2019/0040489 | A1 | 2/2019 | Hasegawa et al. |
| 2019/0193187 | A1 | 6/2019 | Perlade et al. |
| 2020/0270713 | A1 | 8/2020 | Gospodinova et al. |
| 2020/0362432 | A1 | 11/2020 | Jung et al. |

FOREIGN PATENT DOCUMENTS

| | | | |
|---|---|---|---|
| EP | 3017073 | B1 | 8/2017 |
| EP | 3219821 | A1 | 9/2017 |
| EP | 3372703 | A1 | 9/2018 |
| EP | 3409805 | A1 | 12/2018 |
| KR | 1020160035015 | | 3/2016 |
| KR | 101677396 | B1 | 11/2016 |
| KR | 1020200083600 | A | 7/2020 |
| RU | 2246552 | C2 | 1/2004 |
| WO | WO2008102009 | A1 | 8/2008 |
| WO | WO2016001705 | A1 | 1/2016 |
| WO | WO2016001889 | A2 | 1/2016 |
| WO | WO2017108956 | A1 | 6/2017 |
| WO | WO2017108959 | A1 | 6/2017 |
| WO | WO2017131053 | A1 | 8/2017 |

STEEL SHEET HAVING EXCELLENT TOUGHNESS, DUCTILITY AND STRENGTH, AND MANUFACTURING METHOD THEREOF

The present disclosure concerns a method for manufacturing a hot-rolled and annealed steel sheet having high cold-rollability and toughness, and suitable for producing a cold-rolled and heat-treated steel sheet having a high combination of ductility and strength, and to a hot-rolled and annealed steel sheet produced by this method.

The present disclosure also relates to a method for manufacturing a cold-rolled and heat-treated steel sheet having a high combination of ductility and strength, and to a cold-rolled and heat-treated steel sheet obtained by this method.

BACKGROUND

In the automotive industry in particular, there is a continuous need to lighten vehicles, in order to improve their fuel efficiency in view of the global environmental conservation, and to increase safety, by using steels having a high tensile strength. Such steels may indeed be used to produce parts having a lower thickness whilst guaranteeing the same or an improved safety level.

To that end, steels have been proposed that have micro-alloying elements whose hardening is obtained simultaneously by precipitation and by refinement of the grain size. The development of such steels has been followed by those of higher strength called Advanced High Strength Steels which keep good levels of strength together with good cold formability.

For the purpose of obtaining even higher tensile strength levels, steels exhibiting TRIP (Transformation Induced Plasticity) behavior with highly advantageous combinations of properties (tensile strength/deformability) have been developed. These properties are associated with the structure of such steels, which consists of a ferritic matrix containing bainite and residual austenite. The residual austenite is stabilized by an addition of silicon or aluminium, these elements retarding the precipitation of carbides in the austenite and in the bainite. The presence of residual austenite gives an undeformed sheet high ductility. Under the effect of a subsequent deformation, for example when stressed uniaxially, the residual austenite of a part made of TRIP steel is progressively transformed to martensite, resulting in substantial hardening and delaying the appearance of necking.

To achieve an improved combination of strength and ductility, it was further proposed to produce sheets by the so-called "quenching and partitioning" process, wherein the sheets are annealed in the austenitic or in the intercritical domain, cooled down to a quenching temperature below the Ms transformation point, and thereafter heated to a partitioning temperature and maintained at this temperature for a given time. The resulting steel sheets have a structure comprising martensite and retained austenite, and optionally bainite and/or ferrite. The retained austenite has a high C content, resulting from the partitioning of carbon from the martensite during the partitioning, and the martensite comprises a low fraction of carbides.

All these steel sheets present good balances of resistance and ductility.

SUMMARY

However, new challenges appear when it comes to manufacture such sheets. Especially, the manufacturing process of such steel sheets generally comprises, before the heat-treatment imparting its final properties to the steel, casting a steel semi-product, hot-rolling the semi-product to produce a hot-rolled steel sheet, then coiling the hot-rolled steel sheet. The hot-rolled steel sheet is then cold-rolled to the desired thickness, and subjected to a heat-treatment chosen as a function of the desired final structure and properties, to obtain a cold-rolled and heat-treated steel sheet.

Owing to the composition of these steels, a high level of resistance is reached throughout the manufacturing process. Especially, the hot-rolled steel sheet exhibits, before cold-rolling, a high hardness impairing its cold-rollability. As a consequence, the range of available sizes for the cold-rolled sheets is reduced.

In order to solve this problem, it was proposed to subject the hot-rolled steel sheet, prior to cold-rolling, to a batch annealing, at a temperature generally comprised between 500° C. and 700° C., for a time of several hours.

The batch annealing indeed results in a decrease of the hardness of the hot-rolled steel sheet, and therefore improves its cold-rollability.

However, this solution is not entirely satisfactory.

Indeed, the batch annealing treatment generally leads to a decrease of the final properties of the steel, in particular its ductility and strength.

In addition, the hot-rolled steel sheet exhibits an insufficient toughness after batch annealing, which may be the cause of band breakage during further processing.

An object of the present disclosure therefore is providing a hot-rolled steel sheet, and a manufacturing method therefore, having an improved cold-rollability and toughness, whilst being suitable for producing a cold-rolled and heat-treated steel sheet having high mechanical properties, especially a high combination of ductility and strength.

Another object of the present disclosure is providing a cold-rolled and heat treated steel sheet and a manufacturing method thereof, having a high combination of mechanical properties, as compared to similar steel sheets produced by a method including a batch-annealing treatment before cold-rolling.

A method for manufacturing a steel sheet, comprises the steps of:

casting a steel having a composition comprising, by weight percent:

$0.1\% \leq C \leq 0.4\%$
$3.5\% \leq Mn \leq 8.0\%$
$0.1\% \leq Si \leq 1.5\%$
$Al \leq 3\%$
$Mo \leq 0.5\%$
$Cr \leq 1\%$
$Nb \leq 0.1\%$
$Ti \leq 0.1\%$
$V \leq 0.2\%$
$B \leq 0.004\%$
$0.002\% \leq N \leq 0.013\%$
$S \leq 0.003\%$
$P \leq 0.015\%$, the remainder being iron and unavoidable impurities resulting from the smelting, to obtain a steel semi-product, reheating the steel semi-product to a temperature $T_{reheat}$ comprised between 1150° C. and 1300° C., hot rolling the reheated semi-product at a temperature comprised between 800° C. and 1250° C., with a final rolling temperature $T_{FRT}$ higher than or equal to 800° C., thereby obtaining a hot rolled steel sheet, cooling the hot rolled steel sheet down to a coiling temperature $T_{coil}$ lower than or equal to 650° C. at a cooling rate $V_{c1}$ comprised between 1° C./s and 150° C./s, and coiling the hot-rolled steel sheet at the coiling temperature $T_{coil}$, then continuously annealing the hot-rolled steel sheet at a continuous annealing temperature $T_{ICA}$ comprised between $T_{ICAmin}$ and $T_{ICAmax}$, with $T_{ICAmin}$=650° C., and $T_{ICAmax}$ being the temperature at which 30% of austenite is formed upon heating, the hot-rolled steel sheet being held at said continuous annealing temperature $T_{ICA}$ for a continuous annealing time $t_{ICA}$ comprised between 3 s and 3600 s, then, cooling the hot-rolled steel sheet to room temperature, the hot-rolled steel sheet being cooled with an average cooling rate $V_{ICA}$ between 600° C. and 350° C. of at least 1° C./s, thereby obtaining a hot-rolled and annealed steel sheet, cold-rolling the hot-rolled and annealed steel sheet with a cold rolling reduction ratio comprised between 30% and 70%, thereby obtaining a cold-rolled steel sheet.

Preferably, the hot-rolled and annealed steel sheet has a structure consisting, in surface fraction, of:

ferrite, the ferrite grains have an average size of at most 3 μm, at most 30% of austenite, at most 8% of fresh martensite and cementite, having an average Mn content lower than 25%.

Generally, the hot-rolled and annealed steel sheet has a Vickers hardness lower than 400 HV.

Preferably, the hot-rolled and annealed steel sheet has a Charpy energy at 20° C. of at least 50 J/cm$^2$.

Preferably, the method further comprises, between the coiling and the continuous annealing and/or after the continuous annealing, a step of pickling the hot-rolled steel sheet.

Preferably, the continuous annealing time $t_{ICA}$ is comprised between 200 s and 3600 s.

Preferably, the method further comprises, after cold-rolling:

heating the cold-rolled steel sheet to an annealing temperature $T_{anneal}$ comprised between 650° C. and 1000° C., and holding the cold-rolled steel sheet at the annealing temperature $T_{anneal}$ for an annealing time $t_{anneal}$ comprised between 30 s and 10 min.

In a first embodiment, the annealing temperature $T_{anneal}$ is comprised between $T_{ICAmin}$ and Ae3.

In a second embodiment, wherein the annealing temperature $T_{anneal}$ is comprised between Ae3 and 1000° C.

In an embodiment, the method further comprises a step of cooling the cold-rolled steel sheet from the annealing temperature $T_{anneal}$ down to room temperature at a cooling rate $V_{c2}$ comprised between 1° C./s and 70° C./s, to obtain a cold-rolled and heat treated steel sheet.

In another embodiment, the method further comprises, after holding the cold-rolled steel sheet at the annealing temperature $T_{anneal}$, the successive steps of:

cooling the cold-rolled steel sheet from the annealing temperature $T_{anneal}$ down to a holding temperature $T_H$ comprised between 350° C. and 550° C. at a cooling rate $V_{c2}$ comprised between 1° C./s and 70° C./s, maintaining the cold-rolled steel sheet at the holding temperature $T_H$ for a holding time $t_H$ comprised 10 s and 500 s, then, cooling the cold-rolled steel sheet from the holding temperature $T_H$ down to room temperature at a cooling rate $V_{c3}$ comprised between 1° C./s and 70° C./s, to obtain a cold-rolled and heat treated steel sheet.

Preferably, the method further comprises a step of tempering the cold-rolled and heat treated steel sheet at a tempering temperature $T_T$ comprised between 170° C. and 450° C. for a tempering time $t_T$ comprised between 10 s and 1200 s.

Preferably, the method further comprises a step of coating the cold-rolled and heat treated steel sheet with Zn or a Zn alloy, or with Al or an Al alloy.

In another embodiment, the method further comprises the steps of:

quenching the heated cold-rolled steel sheet from the annealing temperature $T_{anneal}$ to a quenching temperature QT comprised between Mf+20° C. and Ms−20° C., at a cooling rate $V_{c4}$ high enough to avoid the formation of ferrite and pearlite upon cooling, reheating the cold-rolled steel sheet from the quenching temperature QT to a partitioning temperature $T_P$ comprised between 350° C. and 500° C., and maintaining the cold-rolled steel sheet at the partitioning temperature $T_P$ for a partitioning time $t_p$ comprised between 3 s and 1000 s, cooling the cold-rolled steel sheet to room temperature, to obtain a cold-rolled and heat treated steel sheet.

In a first variant of this embodiment, the annealing temperature $T_{anneal}$ is such that the cold-rolled steel sheet has a structure, upon annealing, consisting of, in surface fraction:

between 10% and 45% of ferrite, austenite, and at most 0.3% of cementite, the cementite particles, if any, having an average size lower than 50 nm.

In a second variant of this embodiment, the annealing temperature $T_{anneal}$ is higher than Ae3, the cold-rolled steel sheet having a structure, upon annealing, consisting of:

austenite, and at most 0.3% of cementite, the cementite particles, if any, having an average size lower than 50 nm.

After the maintaining of the cold-rolled steel sheet at the partitioning temperature $T_P$, the cold-rolled steel sheet may be immediately cooled to the room temperature.

In a variant, between the maintaining of the cold-rolled steel sheet at the partitioning temperature $T_P$ and the cooling of the cold-rolled steel sheet to the room temperature, the cold-rolled steel sheet is hot-dip coated in a bath.

Preferably, the Si content in the composition is of at most 1.4%.

A cold-rolled and heat treated steel sheet is also provided, made of a steel having a composition comprising, by weight percent:

0.1%≤C≤0.4%

3.5%≤Mn≤8.0%

0.1%≤Si≤1.5%

Al≤3%

Mo≤0.5%

Cr≤1%

Nb≤0.1%

Ti≤0.1%

V≤0.2%

B≤0.004%

0.002%≤N≤0.013%

S≤0.003%

P≤0.015%, the remainder being iron and unavoidable impurities resulting from the smelting, wherein the cold-rolled steel sheet has a structure consisting of, in surface fraction:

between 8 and 50% of retained austenite, at most 80% of intercritical ferrite, the ferrite grains, if any, having an average size of at most 1.5 μm, and at most 1% of cementite, the cementite particles, if any, having an average size lower than 50 nm, martensite and/or bainite.

In an embodiment, the structure comprises, in surface fraction, at least 10% of intercritical ferrite.

In another embodiment, the structure consists of, in surface fraction:

between 8 and 50% of retained austenite, at most 1% of cementite, the cementite particles, if any, having an average size lower than 50 nm, martensite and/or bainite.

In an embodiment, the martensite consists of tempered martensite and/or fresh martensite.

In a first variant of this embodiment, the structure consists of, in surface fraction:

between 8% and 50% of retained austenite, having an average C content of at least 0.4% and an average Mn content of at least 1.3*Mn %, Mn % designating the average Mn content in the steel composition, between 40% and 80% of intercritical ferrite, at most of 15% of martensite and/or bainite, and at most 0.3% of cementite, the cementite particles, if any, having an average size lower than 50 nm.

In a second variant of this embodiment, the structure consists of, in surface fraction:

between 8% and 30% of retained austenite, having an average C content of at least 0.4%, between 70% and 92% of martensite and/or bainite, and at most 1% of cementite, the cementite particles, if any, having an average size lower than 50 nm.

In another embodiment, the structure consists of, in surface fraction:

at most 45% of intercritical ferrite, between 8% and 30% of retained austenite, partitioned martensite, at most 8% of fresh martensite, and at most 1% of cementite, the cementite particles, if any, having an average size lower than 50 nm.

In a first variant of this embodiment, the structure consists of, in surface fraction:

between 10% and 45% of intercritical ferrite, between 8% and 30% of retained austenite, partitioned martensite, at most 8% of fresh martensite, and at most 0.3% of cementite, the cementite particles, if any, having an average size lower than 50 nm.

In a second variant of the embodiment, the structure consists of, in surface fraction:

between 8% and 30% of retained austenite, partitioned martensite, at most 8% of fresh martensite, and at most 1% of cementite, the cementite particles, if any, having an average size lower than 50 nm.

Preferably, the Si content in the composition is of at most 1.4%.

BRIEF DESCRIPTION OF THE DRAWINGS

The present disclosure will now be described in details and illustrated by examples without introducing limitations, with reference to the appended figures among which.

DETAILED DESCRIPTION

Figure 1:
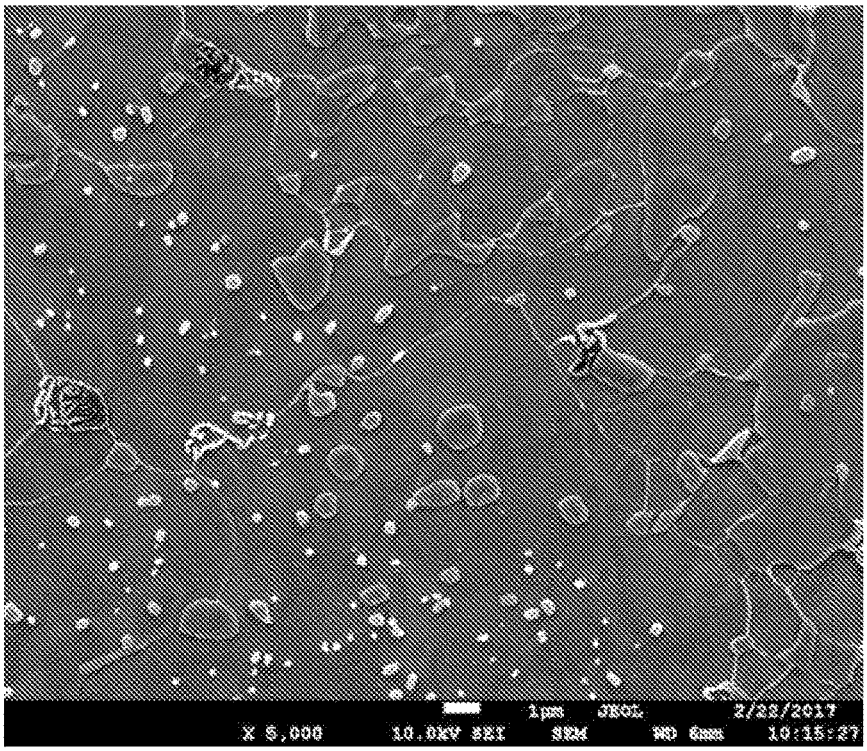
FIG. 1 is a micrograph illustrating the structure of a comparative hot-rolled and batch annealed steel sheet.

According to the present disclosure, the carbon content is between 0.1% and 0.4%. Carbon is an austenite-stabilizing element. Below 0.1%, high levels of tensile strength are difficult to achieve. If the carbon content is greater than 0.4%, the cold-rollability is reduced and the weldability becomes poor. Preferably, the carbon content is comprised between 0.1% and 0.2%.

The manganese content is comprised between 3.5% and 8.0%. Manganese provides a solid solution hardening and a refining effect on the microstructure. Manganese therefore contributes to increasing the tensile strength. In a content above 3.5%, Mn is used to provide an important stabilization of the austenite in the microstructure throughout the whole manufacturing process and in the final structure. Especially, with a Mn content above 3.5%, a final structure of the cold-rolled and heat treated steel sheet comprising at least 8% of retained austenite can be achieved. In addition, owing to the stabilization of the retained austenite with Mn, a high ductility can be obtained. Above 8.0%, weldability becomes poor, while segregations and inclusions deteriorate the damage properties.

Silicon is very efficient to increase the strength through solid solution and stabilize the austenite. Besides, silicon delays the formation of cementite upon cooling by substantially retarding the precipitation of carbides. That results from the fact that the solubility of silicon in cementite is very low and that Si increases the activity of carbon in austenite. Any formation of cementite will therefore be preceded by a step where Si is expelled at the interface. The enrichment of the austenite with carbon therefore leads to its stabilization at room temperature.

For this reason, the Si content is of at least 0.1%. However the Si content is limited to 1.5%, because beyond this value, the rolling loads increase too much and hot rolling process becomes difficult. The cold-rollability is also reduced. In addition, at a too high content, silicon oxides form at the surface, which impairs the coatability of the steel.

Preferably, the Si content is of at most 1.4%. Indeed, a Si content of at most 1.4% reduces or even suppresses the occurrence of red scale (also called tiger stripes), caused by the existence of Fayalite ($Fe_2SiO_4$), upon hot rolling.

Aluminum is a very effective element for deoxidizing the steel in the liquid phase during elaboration. Preferably, the Al content is not less than 0.003% in order to obtain a sufficient deoxidization of the steel in the liquid state.

Furthermore, like Si, Al stabilizes the residual austenite and delays the formation of cementite upon cooling. The Al content is however not higher than 3% in order to avoid the occurrence of inclusions, to avoid oxidation problems and to ensure the hardenability of the material.

The steel according to the present disclosure may contain at least one element chosen among molybdenum and chromium.

Molybdenum increases the hardenability, stabilizes the retained austenite, and reduces the central segregation which can result from the manganese content and which is detrimental to the formability. Above 0.5%, Mo may form too many carbides, which may be detrimental for the ductility.

When Mo is not added, the steel may however comprise at least 0.001% of Mo as an impurity. When Mo is added, the Mo content is generally higher than or equal to 0.05%.

Chromium increases the quenchability of the steel, and contributes to achieving a high tensile strength. A maximum of 1% of chromium is allowed. Indeed, above 1%, a saturation effect is noted, and adding Cr is both useless and expensive. When Cr is added, its content is generally of at least 0.01%. If no voluntary addition of Cr is performed, the Cr content may be present as an impurity, in a content as low as 0.001%.

Micro-alloying elements such as titanium, niobium and vanadium may be added in a content of at most 0.1% of Ti, at most 0.1% of Nb and at most 0.2% of V, in order to obtain an additional precipitation hardening. In particular titanium and niobium are used to control the grain size during the solidification.

When Nb is added, its content is preferably of at least 0.01%. Above 0.1%, a saturation effect is obtained, and adding more than 0.1% of Nb is both useless and expensive.

When Ti is added, its content is preferably of at least 0.015%. When the Ti content is comprised between 0.015% and 0.1%, precipitation at very high temperature occurs in the form of TiN and then, at lower temperature, in the form of fine TiC, resulting in hardening. Furthermore, when titanium is added in addition to boron, titanium prevents combination of boron with nitrogen, the nitrogen being combined with titanium. Hence, when boron is added, the titanium content is preferably higher than 3.42N. However, the Ti content should remain lower than or equal to 0.1% to avoid precipitation of coarse TiN precipitates increasing the hardness of the hot-rolled steel sheet and the cold-rolled steel sheet during the manufacturing process.

Optionally, the steel composition comprises boron, to increase the quenchability of the steel. When B is added, its content is higher than 0.0002%, and preferably higher than or equal to 0.0005%, up to 0.004%. Indeed, above such limit, a saturation level is expected as regard to hardenability.

Sulfur, phosphorus and nitrogen are generally present in the steel composition as impurities.

The nitrogen content is generally of at least 0.002%. The nitrogen content must be of at most 0.013%, so as to prevent precipitation of coarse TiN and/or AlN precipitates degrading the ductility.

As for sulphur, above a content of 0.003%, the ductility is reduced due to the presence of excess sulphides such as MnS, in particular hole-expansion tests show lower values in presence of such sulphides.

Phosphorus is an element which hardens in solid solution but which reduces the spot weldability and the hot ductility, particularly due to its tendency to segregation at the grain boundaries or co-segregation with manganese. For these reasons, its content must be limited to 0.015%, in order to obtain good spot weldability.

The balance is made of iron and inevitable impurities. Such impurity may include at most 0.03% of Cu and at most 0.03% of Ni.

The method according to the present disclosure aims at providing a hot-rolled and annealed steel sheet having a high cold-rollability together with a high toughness, and which is suitable for producing a cold-rolled and heat-treated steel sheet having a high combination of ductility and strength.

The method according to the present disclosure also aims at manufacturing such a cold-rolled and heat-treated steel sheet.

The inventors have investigated the problems of low toughness of the hot-rolled and batch annealed steel sheets, and of degraded mechanical properties of the cold-rolled and heat-treated steel sheets manufactured from such hot-rolled and batch annealed steel sheets, as compared to sheets that would not have been subjected to annealing, and discovered that these problems result from four main factors.

Especially, the inventors have discovered that the batch annealing results in the formation of coarse cementite, highly enriched in manganese, which is therefore strongly stabilized in the hot-rolled and batch-annealed steel sheet. The inventors have further found that the cementite, thus stabilized, does not completely dissolve during the subsequent standard heat-treatment of the cold-rolled steel sheet. Consequently, part of the Mn of the steel remains trapped in cementite, its effect on the strength and ductility of the steel being thus inhibited.

The inventors have further discovered that the batch annealing also results in a coarsening of the structure of the hot-rolled and batch-annealed steel sheet, which results in a coarsening of the final structure of the cold-rolled and heat-treated steel sheet and degrades the mechanical properties.

In addition, the inventors have discovered that the micro-alloying elements that may be included in the steel composition, especially Nb, precipitate at an early stage during the batch-annealing as coarse precipitates, which do not harden the steel, and are consequently no longer available during the subsequent heat-treatment of the cold-rolled steel sheet to provide precipitation hardening.

Finally, the inventors have found that the batch annealing is performed at a temperature and for a time which induce temper embrittlement, resulting in a low toughness of the hot-rolled and batch-annealed steel sheet.

In order to solve these problems, the inventors have performed experiments by increasing the batch annealing temperature above the Ae1 transformation point of the steels.

However, the inventors have found that using higher batch annealing temperatures, though limiting the formation of cementite enriched in Mn, results in a coarsening of the microstructure thereby impairing the final properties of the cold-rolled and heat-treated steel sheet.

From these findings, the inventors discovered that the cold-rollability and the toughness can be highly improved, whilst guaranteeing the final properties of the cold-rolled and heat-treated steel sheets, if the hot-rolled steel sheet is annealed so as to have a microstructure comprising:

ferrite, with an average ferritic grain size of at most 3 μm, at most 30% of austenite, at most 8% of fresh martensite, and cementite, having an average Mn content lower than 25%.

A fresh martensite fraction of at most 8% makes it possible to achieve a high toughness of the hot-rolled and annealed steel sheet.

Especially, the inventors have performed experiments by subjecting hot-rolled steel sheets made of several steels compositions to various annealing conditions leading to varying austenite and fresh martensite fractions after cooling down to room temperature, and measured the Charpy energy at 20° C. of the steel sheets thus obtained.

On the basis of these experiments, the inventors have found that the Charpy energy is an increasing function of the annealing temperature, and a decreasing function of the fresh martensite fraction. Furthermore, the inventors have discovered that a high Charpy energy, of at least 50 J/cm$^2$ at 20° C., is achieved if the hot-rolled and annealed steel sheet has a fresh martensite fraction of at most 8%.

Besides, a cementite having an average Mn content lower than 25% implies that the cementite dissolution is facilitated during the final heat treatment of the cold-rolled steel sheet, which improves ductility and strength during the further processing steps. By contrast, a cementite with an average Mn content above 25% would lead to a decrease in the mechanical properties of the cold-rolled and heat-treated steel sheet produced from the hot-rolled and annealed steel sheet.

In addition, having an average ferritic grain size of at most 3 μm allows producing a cold-rolled and heat-treated having a very fine microstructure, and increasing its mechanical properties.

The inventors have further found that the above microstructure allows achieving a hardness of the hot-rolled and annealed steel sheet lower than 400 HV, guaranteeing a satisfactory cold-rollability of the hot-rolled and annealed steel sheet.

The inventors have found that this microstructure and these properties of the hot-rolled and annealed steel sheet are achieved by performing on the hot-rolled steel sheet a continuous annealing at a continuous annealing temperature $T_{ICA}$ comprised between a minimal continuous annealing temperature $T_{ICAmin}$=650° C. and a maximal continuous annealing temperature $T_{ICAmax}$ which is the temperature at which 30% of austenite is formed upon heating, and for a time comprised between 3 s and 3600 s, and by subsequently cooling the hot-rolled steel sheet under particular cooling conditions.

Especially, the inventors have found that owing to the high continuous annealing temperature $T_{ICA}$, an annealing time of at most 3600 s is sufficient to achieve sufficient tempering of the structure, thereby improving the cold-rollability of the hot-rolled and annealed steel sheet, whilst avoiding coarsening of the structure.

Moreover, annealing the sheet at a temperature higher than 650° C. allows the softening of the hot-rolled steel sheet, limiting the Mn enrichment of cementite particles below 25% and limiting the precipitation of the micro-alloying elements, if any, and preventing the coarsening of such precipitates, thereby retaining the effects of C, Mn and of the micro-alloying elements on the final mechanical properties. It also limits the segregation of embrittling impurities like P at the grain boundaries.

The manufacturing method will be now described in further details.

The method to produce the steel according to the present disclosure comprises casting a steel with the chemical composition of the present disclosure.

The cast steel is reheated to a temperature $T_{reheat}$ comprised between 1150° C. and 1300° C.

When slab reheating temperature $T_{reheat}$ is below 1150° C., the rolling loads increase too much and hot rolling process becomes difficult.

Above 1300° C., oxidation is very intense, which leads to scale loss and surface degradation.

The reheated slab is hot-rolled at a temperature between 1250° C. and 800° C., the last hot rolling pass taking place at a final rolling temperature $T_{FRT}$ higher than or equal to 800° C.

If the final rolling temperature $T_{FRT}$ is below 800° C., the hot workability is reduced.

After hot rolling, the steel is cooled at a cooling rate $V_{c1}$ comprised between 1° C./s and 150° C./s, to a coiling temperature $T_{coil}$ lower than or equal to 650° C. Below 1° C./s, a too coarse microstructure is created and the final mechanical properties deteriorate. Above 150° C./s, the cooling process is difficult to control.

The coiling temperature $T_{coil}$ must be lower than or equal to 650° C. If the coiling temperature is above 650° C., deep intergranular oxidation is formed below scale leading to a deterioration of surface properties.

After coiling, the hot-rolled steel sheet is preferably pickled.

The hot-rolled steel sheet is then continuously annealed, i.e. the uncoiled hot-rolled steel sheet undergoes a heat treatment by continuously travelling within a furnace.

The hot-rolled steel sheet is continuously annealed at a continuous annealing temperature $T_{ICA}$ comprised between the minimal continuous annealing temperature $T_{ICAmin}$=650° C.; and a maximal continuous annealing temperature $T_{ICAmaX}$ which is the temperature at which 30% of austenite is formed upon heating, and for a time comprised between 3 s and 3600 s.

Under these conditions, the microstructure of the steel created during the continuous annealing, before cooling down to room temperature, consists of;

ferrite, less than 30% of austenite cementite having an average Mn content lower than 25%.

If the continuous annealing temperature is lower than 650° C., softening through microstructure recovery is insufficient during the continuous annealing treatment, so that the hardness of the hot-rolled and annealed steel sheet is above 400 HV. A continuous annealing temperature below 650° C. also enhances segregation of embrittling elements, like P, at the grain boundaries and leads to poor toughness values, which are critical for further processing the steel sheets.

If the continuous annealing temperature is higher than $T_{ICAmax}$, a too high austenite fraction will be created during continuous annealing, which may result in an insufficient stabilization of the austenite and the creation of more than 8% of fresh martensite upon cooling.

If the continuous annealing time is lower than 3 s, the hardness of the hot-rolled and annealed steel sheet will be too high, especially higher than 400 HV, so that its cold-rollability will be unsatisfactory. The continuous annealing time is preferably of at least 200 s.

If the continuous annealing time is higher than 3600 s, the microstructure is coarsened; especially, the ferrite grains have an average size higher than 3 μm. Preferably, the continuous annealing time is of at most 500 s.

The austenite which can be created during the annealing is enriched in carbon and manganese, especially has an average Mn content of at least 1.3*Mn %, Mn % designating the Mn content of the steel, and an average C content of at least 0.4%.

The austenite is therefore strongly stabilized.

The hot-rolled steel sheet is then cooled down from the annealing temperature $T_{ICA}$ to room temperature, with an average cooling rate $V_{ICA}$ between 600° C. and 350° C. of at least 1° C./s. Under this condition, the temper embrittlement is limited.

If the cooling rate between 600° C. and 350° C. is lower than 1° C./s, segregation occurs in the hot-rolled and annealed steel sheet enhancing temper embrittlement, so that its cold-rollability is not satisfactory.

The hot-rolled and annealed steel sheet thus obtained has a structure consisting of:

ferrite, at most 30% of austenite, at most 8% of fresh martensite, cementite, having an average Mn content lower than 25%.

A fresh martensite fraction of at most 8% is achieved owing to the stabilization of the austenite with Mn, which therefore does not transform or only to a small extent into fresh martensite upon cooling.

The retained austenite of the hot-rolled and annealed steel sheet has an average Mn content of at least 1.3*Mn %, wherein Mn % designates the Mn content of the steel, and has an average C content of at least 0.4%.

A tempering treatment is optionally performed so as to further limit the fresh martensite fraction.

In addition, the ferrite grains have an average size of at most 3 μm. Indeed, the continuous annealing, performed during a relatively short time as compared to batch annealing, did not result in a coarsening of the structure and therefore allows achieving a hot-rolled and annealed sheet having a very fine structure.

At this stage, the hot-rolled and annealed sheet has improved cold-rollability and toughness, as compared to the hot-rolled steel sheet before annealing. In addition, the hot-rolled and annealed steel sheet is suitable for producing a cold-rolled and heat treated steel sheet having high mechanical properties, especially high ductility and strength.

In particular, the hot-rolled and annealed sheet has a Vickers hardness lower than 400 HV, and has therefore a very good cold-rollability.

In addition, the hot-rolled and annealed steel sheet has a Charpy energy at 20° C. of at least 50 J/cm$^2$. Therefore, the hot-rolled and annealed steel sheet has a very good processability and the risks of band breakage during further processing is strongly decreased as compared to hot rolled steel sheets that would have been batch annealed. Moreover, the inventors have discovered that not only is the Charpy energy of the hot-rolled and annealed steel sheet higher than hot rolled and batch annealed steel sheets, but it is also generally higher than the Charpy energy of the hot-rolled steel sheet from which the hot-rolled and annealed steel sheet was produced.

After cooling down to room temperature, the hot-rolled and annealed steel sheet is optionally pickled. However, this step may be omitted. Indeed, owing to the short duration of the continuous annealing, no or little internal oxidation occurs during the continuous annealing. Preferably, the hot-rolled and annealed steel sheet is pickled at this stage if no pickling was performed between the hot-rolling and the continuous annealing.

The hot-rolled steel sheet is then cold-rolled, with a cold-rolling reduction ratio comprised between 30% and 70%, to obtain a cold-rolled steel sheet. Below 30%, the recrystallization during subsequent heat-treatment is not favored, which may impair the ductility of the cold-rolled steel sheet after heat-treatment. Above 70%, there is a risk of edge cracking during cold-rolling.

The cold-rolled steel sheet is then heat-treated on a continuous annealing line to produce a cold-rolled and heat-treated steel sheet.

The heat-treatment performed on the cold-rolled steel sheet is chosen depending on the final mechanical properties targeted.

In any case, the heat-treatment comprises the steps of heating the cold-rolled steel sheet to an annealing temperature $T_{anneal}$ comprised between 650° C. and 1000° C., and holding the cold-rolled steel sheet at the annealing temperature $T_{anneal}$ for an annealing time $t_{anneal}$ comprised between 30 s and 10 min.

In addition, the annealing temperature $T_{anneal}$ is such that the structure created upon annealing comprises at least 8% of austenite.

If the annealing temperature is lower than 650° C., cementite will be created in the structure during the annealing, resulting in a degradation of the mechanical properties of the cold-rolled and heat-treated steel sheet.

The annealing temperature $T_{anneal}$ is of at most 1000° C. in order to limit the coarsening of the austenitic grains.

The reheating rate Vr to the annealing temperature $T_{anneal}$ is preferably comprised between 1° C./s and 200° C./s.

According to a first embodiment, the annealing is an intercritical annealing, the annealing temperature $T_{anneal}$ being lower than Ae3 and such that the structure created upon annealing comprises at least 8% of austenite.

According to a second embodiment, the annealing temperature $T_{anneal}$ is higher than or equal to Ae3, so as to obtain, upon annealing, a structure consisting of austenite and at most 1% of cementite.

In the first embodiment, at the end of the holding at the annealing temperature, the austenite has a C content of at least 0.4% and an average Mn content of at least 1.3*Mn %.

The cold-rolled and annealed steel sheet is then cooled down to room temperature, either directly, i.e. without any holding, tempering or reheating step between the annealing temperature $T_{anneal}$ and room temperature, or indirectly, i.e. with holding, tempering and/or reheating steps, to obtain a cold-rolled and heat-treated steel sheet.

In any case, the cold-rolled and heat-treated steel sheet has a structure (hereinafter final structure) comprising:

between 8% and 50% of retained austenite, martensite, which may include fresh martensite and/or partitioned or tempered martensite, and optionally bainite, at most 80% of intercritical ferrite, and at most 1% of cementite.

The retained austenite generally has an average C content of at least 0.4% and generally an average Mn content of at least 1.3*Mn %.

Owing to the Mn content in cementite of at most 25% in the microstructure of the hot-rolled and annealed steel sheet, cementite is easily dissolved upon annealing. Depending on the heat-treatment performed, a small fraction of cementite may remain in the final structure. However, the cementite fraction in the final structure will in any case remain lower than 1%. In addition, the cementite particles, if any, have an average size lower than 50 nm.

The martensite may comprise fresh martensite and partitioned martensite or tempered martensite.

As explained in further details below, partitioned martensite has an average C content strictly lower than the nominal C content of the steel. This low C content results from the partitioning of carbon from the martensite, created upon quenching below the Ms temperature of the steel, to the austenite, during the holding at a partitioning temperature $T_P$ comprised between 350° C. and 500° C.

By contrast, tempered martensite has an average C content which equals the nominal C content of the steel. Tempered martensite results from a tempering of the martensite created upon quenching below the Ms temperature of the steel.

Partitioned martensite can be distinguished from tempered martensite and fresh martensite on a section polished and etched with a reagent known per se, for example Nital reagent, observed by Scanning Electron Microscopy (SEM) and Electron Backscatter Diffraction (EBSD).

The structure may comprise bainite, especially carbides free bainite, containing less than 100 carbides per surface unit of 100 $mm^2$.

The ferrite fraction depends on the annealing temperature during the heat-treatment.

The ferrite, when present in the final structure, is intercritical ferrite.

Therefore, the ferrite, when present, is inherited from the structure of the hot-rolled and annealed steel sheet, which is then cold-rolled and recrystallized. As a result, the ferrite has an average grain size of at most 1.5 μm.

The preferred heat-treatments performed on the cold-rolled steel sheets will now be described in further details.

In a first preferred heat-treatment, after holding at the annealing temperature $T_{anneal}$ lower than or higher than Ae3, the cold-rolled steel sheet is cooled down to room temperature at a cooling rate $Vc_2$ comprised between 1° C./s and 70° C./s.

The cold-rolled steel sheet is cooled at the cooling rate $Vc_2$ to the room temperature, or cooled, at the cooling rate $Vc_2$, to a holding temperature $T_H$ comprised between 350° C. and 550° C. and held at the holding temperature $T_H$ for a time between 10 s and 500 s. It was shown that such a thermal treatment, which facilitates the Zn coating by hot dip process for instance, does not affect the final mechanical properties. After the optional holding at the holding temperature $T_H$, the cold-rolled steel sheet is cooled down to room temperature at a cooling rate $Vc_3$ comprised between 1° C./s and 70° C./s Optionally, after cooling down to the room temperature, the cold rolled and heat-treated steel sheet is tempered at a temperature $T_t$ comprised between 170 and 450° C. for a tempering time $t_t$ comprised between 10 and 1200 s.

This treatment enables the tempering of martensite, which may be created during cooling to room temperature after the annealing. The martensite hardness is thus decreased and the ductility is improved. Below 170° C., the tempering treatment is not efficient enough. Above 450° C., the strength loss becomes high and the balance between strength and ductility is not improved anymore.

The structure of the cold-rolled and heat-treated steel sheet obtained with the first preferred heat-treatment consists of, in surface fraction:

- between 8% and 50% of retained austenite, having an average C content of at least 0.4%,
- at most 80% of intercritical ferrite,
- at most of 92% of martensite and/or bainite,
- at most 1% of cementite.

The martensite consists of tempered martensite and/or fresh martensite.

The structure may comprise bainite, especially carbides free bainite, containing less than 100 carbides per surface unit of 100 $mm^2$.

The average size of the cementite particles is lower than 50 nm.

The ferrite and austenite fractions depend on the annealing temperature during the heat-treatment.

In a first variant of the first preferred heat-treatment, the annealing temperature $T_{anneal}$ is lower than Ae3, and preferably such that the structure created upon annealing comprises between 40% and 80% of ferrite.

In this first variant, the final structure preferably comprises, in surface fraction:

- 8% to 50% of retained austenite, having an average C content of at least 0.4% and an average Mn content of at least 1.3*Mn %,
- 40% to 80% of intercritical ferrite, the ferrite grains having an average size of at most 1.5 μm,
- at most 15% of martensite (consisting of tempered martensite and/or fresh martensite) and/or bainite,
- at most 0.3% of cementite, the cementite particles, if any, having an average size lower than 50 nm.

In a second variant of the first preferred heat-treatment, the annealing temperature is higher than or equal to Ae3.

In this second variant, the final structure consists of:

- 8% to 30% of retained austenite, having an average C content of at least 0.4%,
- 70% to 92% of martensite (consisting of tempered martensite and/or fresh martensite) and/or bainite,
- at most 1% of cementite, the cementite particles, if any, having an average size lower than 50 nm.

In a second preferred heat-treatment, the cold-rolled steel sheet is subjected to a quenching and partitioning process.

To that end, after holding at the annealing temperature $T_{anneal}$, the cold-rolled steel sheet is quenched from the annealing temperature $T_{anneal}$ to a quenching temperature QT lower than the Ms transformation point of the austenite, at a cooling rate $Vc_4$ high enough to avoid the formation of ferrite and pearlite upon cooling.

The cooling rate $Vc_4$ to the quenching temperature QT is preferably at least 2° C./s.

During this quenching step, the austenite partly transforms into martensite.

The quenching temperature is selected between Mf+20° C. and Ms−20° C., depending on the desired final structure, especially on the fractions of partitioned martensite and retained austenite desired in the final structure. For each particular composition of the steel and each structure, one skilled in the art knows how to determine the Ms and Mf start and finish transformation points of the austenite by dilatometry.

If the quenching temperature QT is lower than Mf+20° C., the fraction of partitioned martensite in the final structure is too high. Moreover, if the quenching temperature QT is higher than Ms−20° C., the fraction of partitioned martensite in the final structure is too low, so that a high ductility will not be reached.

One skilled in the art knows how to determine the quenching temperature adapted to obtain a desired structure.

The cold-rolled steel sheet is optionally held at the quenching temperature QT for a holding time tQ comprised between 2 s and 200 s, preferably between 3 s and 7 s, so as to avoid the creation of epsilon carbides in martensite, that would result in a decrease in the ductility of the steel.

The cold-rolled steel sheet is then reheated to a partitioning temperature $T_P$ comprised between 350° C. and 500° C., and maintained at the partitioning temperature $T_P$ for a partitioning time $t_p$ comprised between 3 s and 1000 s. During this partitioning step, the carbon diffuses from the martensite to the austenite thereby achieving an enrichment in C of the austenite.

If the partitioning temperature $T_P$ is higher than 500° C. or lower than 350° C., the elongation of the final product is not satisfactory.

Optionally, the cold-rolled steel sheet is hot-dip coated in a bath at a temperature for example lower than or equal to 480° C. Any kind of coatings can be used and in particular, zinc or zinc alloys, like zinc-nickel, zinc-magnesium or zinc-magnesium-aluminum alloys, aluminum or aluminum alloys, for example aluminum-silicium.

Immediately after the partitioning step, or after the hot-dip coating step, if performed, the cold-rolled steel sheet is cooled to the room temperature, to obtain a cold-rolled and heat treated steel sheet. The cooling rate to the room temperature is preferably higher than 1° C./s, for example comprised between 2° C./s and 20° C./s.

The final structure of the cold-rolled and heat-treated steel sheet obtained through the second preferred heat-treatment mainly depends on the annealing temperature $T_{anneal}$ and on the quenching temperature QT.

However, the structure of the cold-rolled and heat-treated steel sheet thus obtained generally consists of, in surface fraction:

between 8% and 30% of retained austenite,
at most 45% of intercritical ferrite,
partitioned martensite,
at most 8% of fresh martensite,
at most 1% of cementite.

The retained austenite is enriched in carbon, especially has an average C content of at least 0.4%.

The ferrite, if any, is intercritical ferrite, and has an average grain size of at most 1.5 μm.

The fraction of fresh martensite in the structure is lower than or equal to 8%. Indeed, a fraction of fresh martensite higher than 8% would impair the hole expansion ratio HER.

In this second preferred heat-treatment, a small fraction of cementite may be created upon cooling from the annealing temperature and during partitioning. However, the cementite fraction in the final structure will in any case remain lower than 1% and the average size of the cementite particles in the final structure remains lower than 50 nm.

The retained austenite is enriched in Mn and C. Especially, the average C content in the retained austenite is of at least 0.4%, and the average Mn content in the retained austenite is of at least 1.3*Mn %.

In a second variant of the second preferred embodiment, the annealing temperature $T_{anneal}$ is higher than or equal to Ae3, so that that the cold-rolled steel sheet has a structure, upon annealing, consisting of austenite and at most 0.3% of cementite.

In this second variant, the quenching temperature QT is preferably selected so as to obtain, just after quenching, a structure consisting of at most between 8% and 30% of austenite, at most 92% of martensite and at most 1% of cementite.

In this second variant, the final structure consists of, in surface fraction:

between 8% and 30% of retained austenite,
partitioned martensite,
at most 8% of fresh martensite, and
at most 1% of cementite, the cementite particles, if any, having an average size lower than 50 nm.

The retained austenite is enriched in C, the average C content in the retained austenite being of at least 0.4%.

The microstructural features described above are for example determined by observing the microstructure with a Scanning Electron Microscope with a Field Emission Gun ("FEG-SEM") at a magnification greater than 5000×, coupled to an Electron Backscatter Diffraction ("EBSD") device and to a Transmission Electron Microscopy (TEM).

Examples

As examples and comparison, sheets made of steels compositions according to table I, have been manufactured, the contents being expressed by weight percent.

TABLE 1

| Steel | C (%) | Mn (%) | S (%) | P (%) | Si (%) | Al (%) | Mo (%) | Cr (%) | Nb (%) | Ti (%) | B (%) | N (%) |
|---|---|---|---|---|---|---|---|---|---|---|---|---|
| I1 | 0.174 | 3.8 | 0.0015 | 0.0130 | 1.52 | 0.757 | 0.2 | 0 | 0.03 | <0.005 | <0.0005 | 0.0127 |
| I2 | 0.114 | 4.78 | <0.001 | 0.014 | 0.465 | 1.58 | <0.005 | <0.005 | 0.03 | <0.005 | <0.0005 | 0.003 |
| I3 | 0.188 | 4.04 | 0.0012 | 0.013 | 1.19 | 0.781 | 0.2 | 0.505 | 0.022 | 0.04 | 0.0022 | 0.0047 |
| I4 | 0.109 | 5.17 | 0.003 | 0.015 | 0.507 | 1.81 | <0.005 | <0.005 | <0.002 | <0.01 | <0.0005 | 0.005 |
| I5 | 0.127 | 4.96 | 0.0019 | <0.01 | 0.51 | 1.76 | <0.005 | <0.005 | 0.027 | <0.01 | <0.0005 | 0.002 |
| I6 | 0.18 | 4.01 | 0.0023 | <0.01 | 1.51 | 0.033 | 0.207 | <0.005 | <0.002 | 0.017 | 0.0026 | 0.0028 |
| I7 | 0.146 | 3.78 | 0.001 | 0.009 | 1.46 | 0.79 | 0.187 | <0.005 | 0.058 | <0.01 | <0.0005 | 0.005 |

In a first variant of the second preferred embodiment, the annealing temperature $T_{anneal}$ is such that the cold-rolled steel sheet has a structure, upon annealing, consisting of, in surface fraction:

between 10% and 45% of ferrite,
austenite, and
at most 0.3% of cementite, the cementite particles, if any, having an average size lower than 50 nm.

In this first variant, the final structure preferably comprises, in surface fraction:

between 10% and 45% of intercritical ferrite, having an average grain size of at most 1.5 μm
between 8% and 30% of retained austenite,
partitioned martensite,
at most 8% of fresh martensite, and
at most 0.3% of cementite, the cementite particles, if any, having an average size lower than 50 nm.

In a first experiment, steels I1, I2, I3, I6 and I7 were cast so as to obtain ingots. The ingots were reheated at a temperature $T_{reheat}$ of 1250° C., de-scaled and hot-rolled at a temperature higher than Ar3 to obtain hot rolled steels.

The hot-rolled steels were then cooled at a cooling rate $V_{c1}$ comprised between 1° C./s and 150° C. to a coiling temperature $T_{coil}$ and coiled at this temperature $T_{coil}$.

Some of the hot-rolled steels were then either continuously annealed or batch annealed at an annealing temperature $T_A$ for an annealing time $t_A$ then cooled down to room temperature with an average cooling rate $V_{ICA}$ between 600° C. and 350° C.

The manufacturing conditions of the hot-rolled and annealed steel sheets are reported in Table 2 below, as well as the austenite fraction created upon annealing.

TABLE 2

| Example | | Steel | $T_{coil}$ (° C.) | $T_{ICA}$ (° C.) | Austenite fraction upon annealing (%) | $t_{ICA}$ (s) | $V_{ICA}$ (° C./s) |
|---|---|---|---|---|---|---|---|
| 1 | I1A | I1 | 450 | | | no annealing | |
| 2 | I1B | I1 | 450 | 500 | 0 | 25200 | 0.028 |
| 3 | I1C | I1 | 450 | 600 | 0 | 25200 | 0.028 |
| 4 | I1D | I1 | 450 | 650 | 5 | 25200 | 0.028 |
| 5 | I1E | I1 | 450 | 680 | 11 | 25200 | 0.028 |
| 6 | I1F | I1 | 450 | 700 | 25 | 120 | 30 |
| 7 | I1G | I1 | 450 | 720 | 34 | 120 | 30 |
| 8 | I2A | I2 | 450 | | | no annealing | |
| 9 | I2B | I2 | 450 | 500 | 2.2 | 25200 | 0.028 |
| 10 | I2C | I2 | 450 | 600 | 8.7 | 25200 | 0.028 |
| 11 | I2D | I2 | 450 | 650 | 22.6 | 25200 | 0.028 |
| 12 | I2H | I2 | 20 | 650 | 0 | 720 | 70 |
| 13 | I2J | I2 | 20 | 700 | 28.5 | 3600 | 70 |
| 14 | I2K | I2 | 450 | 700 | 26.9 | 120 | 70 |
| 15 | I3A | I3 | 450 | | | no annealing | |
| 16 | I3B | I3 | 450 | 500 | 0 | 25200 | 0.028 |
| 17 | I3C | I3 | 450 | 600 | 0 | 25200 | 0.028 |
| 18 | I3D | I3 | 450 | 650 | 9.8 | 25200 | 0.028 |
| 19 | I3E | I3 | 450 | 680 | 23.8 | 25200 | 0.028 |
| 20 | I3L | I3 | 20 | 550 | 0 | 720 | 70 |
| 21 | I3H | I3 | 20 | 650 | 0 | 720 | 70 |
| 22 | I3M | I3 | 20 | 700 | n.d. | 120 | 70 |
| 23 | I3N | I3 | 20 | 700 | n.d. | 360 | 70 |
| 24 | I3O | I3 | 20 | 700 | n.d. | 720 | 70 |
| 25 | I3P | I3 | 20 | 700 | n.d. | 1800 | 70 |
| 26 | I3J | I3 | 20 | 700 | 18.2 | 3600 | 70 |
| 27 | I3Q | I3 | 20 | 750 | 45 | 120 | 70 |
| 28 | I6A | I7 | 450 | | | no annealing | |
| 29 | I6C | I7 | 450 | 600 | 0 | 25200 | 0.028 |
| 30 | I6D | I7 | 450 | 650 | 15 | 25200 | 0.028 |
| 31 | I6K | I7 | 450 | 700 | | 120 | 70 |
| 32 | I7A | I8 | 450 | | | no annealing | |
| 33 | I7C | I8 | 450 | 600 | 0 | 25200 | 0.028 |
| 34 | I7D | I8 | 450 | 650 | 6 | 25200 | 0.028 |
| 35 | I7K | I8 | 450 | 700 | n.d. | 120 | 70 |
| 36 | I2L | I2 | 20 | 660 | 4.3 | 300 | 0.03 |
| 37 | I2M | I2 | 20 | 660 | 4.3 | 300 | 0.05 |
| 38 | I2N | I2 | 20 | 660 | 4.3 | 300 | 0.1 |
| 39 | I2O | I2 | 20 | 660 | 4.3 | 300 | 1 |
| 40 | I2P | I2 | 20 | 660 | 4.3 | 300 | 2.5 |
| 41 | I2Q | I2 | 20 | 660 | 4.3 | 300 | 5 |
| 42 | I2R | I2 | 20 | 660 | 4.3 | 300 | 10 |
| 43 | I6L | I6 | 20 | 660 | 12 | 300 | 0.03 |
| 44 | I6M | I6 | 20 | 660 | 12 | 300 | 0.05 |
| 45 | I6N | I6 | 20 | 660 | 12 | 300 | 1 |
| 46 | I6O | I6 | 20 | 660 | 12 | 300 | 2.5 |
| 47 | I6P | I6 | 20 | 660 | 12 | 300 | 5 |
| 48 | I6Q | I6 | 20 | 660 | 12 | 300 | 10 |

In Table 2, the underlined values are not according to the present disclosure, and "n.d." means "not determined".

The inventors have investigated the microstructures of the hot-rolled and optionally annealed steel sheets thus obtained with a Scanning Electron Microscope with a Field Emission Gun ("FEG-SEM") at a magnification of 5000×, coupled to an Electron Backscatter Diffraction ("EBSD") device and to a Transmission Electron Microscopy (TEM).

Especially, the inventors measured the ferrite grain size, the surface fraction of fresh martensite (FM), the surface fraction of austenite (RA) and the average Mn content in the cementite (Mn % in cementite).

The inventors have further measured the Charpy energy at 20° C. and the Vickers hardness of the hot-rolled steel sheets. The features of the microstructures and the mechanical properties are reported in Table 3 below.

TABLE 3

| Example | | Ferrite grain size (μm) | FM (%) | Austenite fraction at the end of soaking (%) | Mn % in cementite (%) | Charpy toughness at 20° C. ($J/cm^2$) | Hardness |
|---|---|---|---|---|---|---|---|
| 1 | I1A | <3 | <8 | n.d. | n.d. | 40 | 424 |
| 2 | I1B | <3 | <8 | 0 | 58 | 18 | 364 |
| 3 | I1C | <3 | <8 | 0 | 44 | 19 | 328 |
| 4 | I1D | >3 | <8 | 5 | 32 | 20 | 272 |
| 5 | I1E | 6 | <8 | 11 | 24 | 45 | 255 |
| 6 | I1F | <3 | <8 | 25 | 15 | 65 | 340 |
| 7 | I1G | <3 | 9 | 34 | n.d. | 39 | 430 |
| 8 | I2A | <3 | >8 | n.d. | n.d. | 98 | 429 |

TABLE 3-continued

| Example | | Ferrite grain size (μm) | FM (%) | Austenite fraction at the end of soaking (%) | Mn % in cementite (%) | Charpy toughness at 20° C. (J/cm$^2$) | Hardness |
|---|---|---|---|---|---|---|---|
| 9 | I2B | <3 | <8 | 2.2 | 70 | 43 | 363 |
| 10 | I2C | <3 | <8 | 8.7 | 41 | 45 | 320 |
| 11 | I2D | >3 | <8 | 22.6 | n.d. | 84 | 298 |
| 12 | I2H | <3 | <8 | 0 | 17.7 | 108 | 337 |
| 13 | I2J | <3 | 2 | 28.5 | n.d. | 175 | 311 |
| 14 | I2K | <3 | <8 | 26.9 | n.d. | 140 | 334 |
| 15 | I3A | <3 | >8 | n.d. | n.d. | 70 | 458 |
| 16 | I3B | <3 | <8 | 0 | 49 | 12 | n.d. |
| 17 | I3C | <3 | <8 | 0 | 39 | 4 | n.d. |
| 18 | I3D | >3 | <8 | 9.8 | 31 | 21 | n.d. |
| 19 | I3E | >3 | >8 | 23.8 | 23 | 24 | n.d. |
| 20 | I3L | <3 | <8 | 0 | <25 | 24 | 435 |
| 21 | I3H | <3 | <8 | 0 | 20 | 50 | 380 |
| 22 | I3M | <3 | <8 | n.d. | <15 | 65 | 386 |
| 23 | I3N | <3 | <8 | n.d. | <15 | 82 | n.d. |
| 24 | I3O | <3 | <8 | n.d. | <15 | 89 | n.d. |
| 25 | I3P | <3 | <8 | n.d. | <15 | 95 | n.d. |
| 26 | I3J | <3 | 2 | 18.2 | <15 | 86 | n.d. |
| 27 | I3Q | <3 | 29 | 45 | nd | 26 | 461 |
| 28 | I6A | <3 | <8 | nd | nd | 65 | 484 |
| 29 | I6C | <3 | <8 | 0 | 33 | 14 | 293 |
| 30 | I6D | n.d. | n.d. | 15 | 23 | 31 | 240 |
| 31 | I6K | <3 | <8 | n.d. | n.d. | n.d. | n.d. |
| 32 | I7A | <3 | <8 | nd | nd | 71 | 444 |
| 33 | I7C | <3 | <8 | 0 | 45 | 6.8 | 344 |
| 34 | I7D | n.d. | n.d. | 6 | 35 | 28 | 271 |
| 35 | I7K | <3 | <8 | n.d. | n.d. | n.d. | n.d. |
| 36 | I2L | <3 | <8 | 4.3 | <25 | 37 | 302 |
| 37 | I2M | <3 | <8 | 4.3 | <25 | 38 | 305 |
| 38 | I2N | <3 | <8 | 4.3 | <25 | 41 | 307 |
| 39 | I2O | <3 | <8 | 4.3 | <25 | 50 | 311 |
| 40 | I2P | <3 | <8 | 4.3 | <25 | 51 | 311 |
| 41 | I2Q | <3 | <8 | 4.3 | <25 | 52 | 311 |
| 42 | I2R | <3 | <8 | 4.3 | <25 | 53 | 311 |
| 43 | I6L | <3 | <8 | 12 | <25 | 46 | 286 |
| 44 | I6M | <3 | <8 | 12 | <25 | 49 | 290 |
| 45 | I6N | <3 | <8 | 12 | <25 | 75 | 301 |
| 46 | I6O | <3 | <8 | 12 | <25 | 85 | 301 |
| 47 | I6P | <3 | <8 | 12 | <25 | 88 | 301 |
| 48 | I6Q | <3 | <8 | 12 | <25 | 90 | 301 |

In this Table, n.d. means "not determined". The underlines values are not according to the present disclosure.

These experiments shows that only when the hot-rolled steel sheets annealed under the conditions of embodiments of the present disclosure are the targeted microstructure and the targeted mechanical properties of the hot-rolled and annealed steel sheets achieved.

By contrast, examples I1A, I2A, I3A, I6A and I7A were not subjected to any annealing.

As a result, their hardness is higher than 400 HV, so that the cold-rollability of these hot-rolled steel sheets is insufficient.

Examples I1B, I2B and I3B were batch annealed at a temperature of 500° C. for a time of 25200 s. The batch annealing resulted in a decrease in hardness as compared to examples I1A, I2A and I3A respectively, not subjected to any annealing. However, the batch annealing resulted in a decrease in the Charpy energy, so that the processability of examples I1B, I2B and I3B is insufficient. In addition, the batch annealing resulted in the creation of cementite highly enriched in Mn.

Example I1C, I2C, I3C, I6C and 7C were also subjected to a batch annealing, at a temperature of 600° C. for 25200 s. As a result of the batch annealing, the hardness of these examples decreased, as compared to examples I1A, I2A, I3A, I6A and I7A respectively, and further decreased as compared to examples I1B, I2B and I3B. However, the Charpy energy remained lower than 50 J/cm$^2$, and the batch annealing resulted in the creation of cementite highly enriched in Mn.

The inventors then performed experiments by increasing the batch annealing temperature to 650° C., above the Ae1 transformation point (examples I1D, I2D, I3D, I6D and I7D). This higher batch annealing temperature resulted in an increase in the Charpy energy of the sheets, and to a decrease in the average Mn content in cementite, as compared to examples I1C, I2C, I3C, I6C and I7C respectively.

Nevertheless, the batch annealing at a temperature above Ae1 resulted in a coarsening of the microstructure, the ferrite grain size being higher than 3 μm.

The inventors further increased the batch annealing temperature to 680° C. (examples I1E and I3E). This increase in the batch annealing temperature resulted in a further increase of the Charpy energy and to a further decrease of the average Mn content in cementite. However, this increase in the batch annealing temperature also resulted in a further undesired increase in the ferrite grain size.

These examples thus show that, even if the batch annealing reduces the hardness of the hot-rolled steel sheet, the Chary energy of the hot-rolled and batch annealed steel sheets is generally insufficient to ensure a high processability of the steel sheets. In addition, the batch annealing results in an undesired creation of cementite highly enriched in Mn. These examples further show that, though the increase of the batch annealing temperature may result in an increase in the Charpy energy and to a decrease in the average Mn content in the cementite, the Charpy energy remains in most of the cases lower than the targeted value of 50 J/cm$^2$, and the increase in the batch annealing temperature leads to an undesired coarsening of the microstructure.

Example I3L was subjected to a continuous annealing, with however a continuous annealing temperature lower than 650° C. Consequently, softening through microstructure recovery was insufficient, so that the hardness of example I3L is higher than 400 HV and the Charpy energy insufficient.

Examples I1G and I3Q were continuously annealed with an annealing temperature such that more than 30% of austenite was created upon annealing. As a result, the fresh martensite fraction in the hot-rolled and annealed steel sheets is higher than 8%, so that the hardness of these examples is higher than 400 HV and their Charpy energy lower than 50 J/cm$^2$.

Examples I1F, I2H, I2J, I2K, I3H, I3M, I3, I3O, I3P, I3J, I6K and I7K were subjected to a continuous annealing under the conditions of embodiments of the present disclosure. Consequently, the hot-rolled and annealed steel sheets have a Charpy energy at 20° C. of at least 50 J/cm2 and a hardness lower than or equal to 400 HV. These hot-rolled and annealed steel sheets have therefore satisfactory cold-rollability and processability. In addition, the microstructure of these examples is such that the average ferrite grain size is lower than 3 μm, and the average Mn content in the cementite is lower than 25%. Consequently, these hot-rolled steel sheets are suitable for producing cold-rolled and heat-treated steel sheets having high mechanical properties.

The microstructures of the hot-rolled and annealed steel sheet thus obtained were observed.

Figure 2:
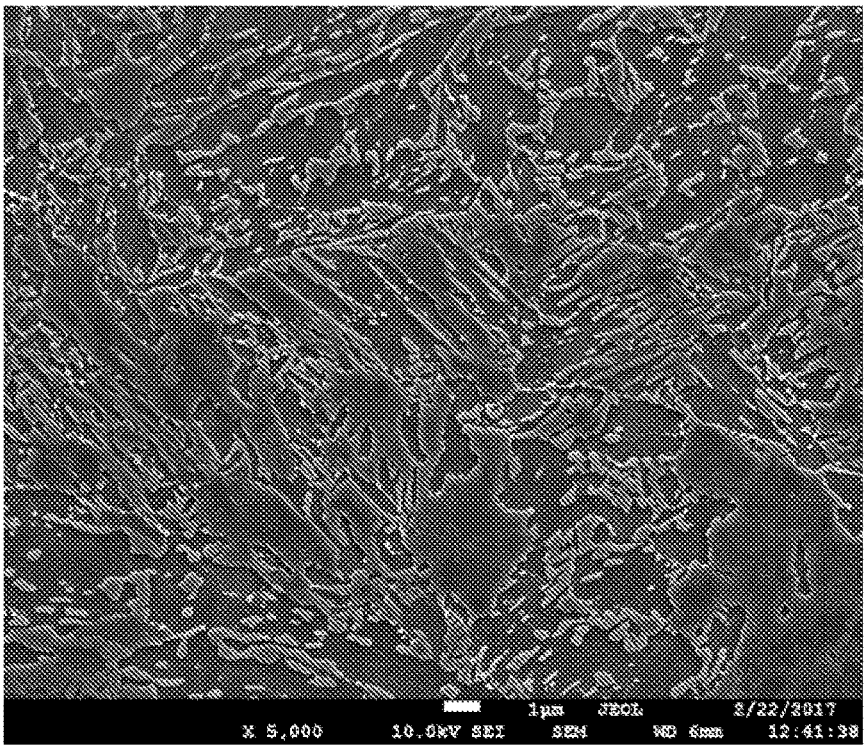
FIG. 2 is a micrograph illustrating the structure of a hot-rolled steel continuously annealed according to an embodiment of the present disclosure.

The microstructure of examples I1E and I1F are shown on FIGS. 1 and 2 respectively.

As visible on these figures, the microstructure of steel I1F, produced with a continuous annealing according to an embodiment of the present disclosure, is much finer than the microstructure of steel I1E, produced with a batch annealing above Ae1.

These experiments demonstrate that unlike the batch annealing, the continuous annealing according to an embodiment of the present disclosure results in a very fine microstructure.

The inventors have further performed experiments to evaluate the final properties of cold-rolled and heat-treated steels produced from batch annealing at a temperature lower than Ae1 or higher than Ae1, or subjected to a continuous annealing according to an embodiment of the present disclosure before cold-rolling.

Especially, steels I1, I2, I4, I5, I6 and I7 were cast so as to obtain ingots. The ingots were reheated at a temperature $T_{reheat}$ of 1250° C., descaled and hot-rolled at a temperature higher than Ar3 to obtain a hot rolled steel.

The hot-rolled steel sheets were then coiled at a temperature $T_{coil}$.

The hot-rolled steels sheets were then either batch annealed or continuously annealed.

The hot-rolled and annealed steel sheets were then cold-rolled with a cold-rolling reduction ratio of 50%, and subjected to various heat-treatments, comprising annealing then cooling down to room temperature at a cooling rate $Vc_1$.

The yield strength, the tensile strength, the uniform elongation and the hole expansion ratio of the cold-rolled and heat-treated steel sheets thus obtained where then measured.

The manufacturing conditions and the measured properties are reported in Tables 4 and 5.

In these tables, $T_{coil}$ designates the coiling temperature, $T_A$ and $t_A$ are the batch or continuous annealing temperature and time, HBA refers to batch annealing, ICA refers to the continuous annealing according to an embodiment of the present disclosure, $T_{anneal}$ is the annealing temperature, $t_{anneal}$ is the annealing time and VC, the cooling rate (or the cooling conditions).

The measured properties reported in Tables 4 and 5 are the yield strength YS, the tensile strength TS, the uniform elongation UE and the hole expansion ratio HER.

In these tables, "n.d." means "not determined". The underlined values are not according to the present disclosure.

TABLE 4

| Ex. | $T_{coil}$ (° C.) | TA (° C.) | $t_A$ (min) | $T_{anneal}$ (° C.) | $t_{anneal}$ (s) | Vc1 (° C./s) | YS (MPa) | TS (MPa) | UE (%) | HER (%) |
|---|---|---|---|---|---|---|---|---|---|---|
| I1Fa | 450 | 700 (ICA) | 2 | 730 | 240 | 25 | 748 | 1229 | 14.1 | n.d. |
| I1Fb | 450 | 700 (ICA) | 2 | 710 | 240 | 25 | 775 | 1043 | 22 | n.d. |
| I2Vc | 450 | 600 (HBA) | 900 | 720 | 120 | 20 | 814 | 965 | 17.6 | 23 |
| I2Kc | 450 | 700 (ICA) | 2 | | | | 902 | 1024 | 19.6 | 22 |
| I2Vd | 450 | 600 (HBA) | 900 | 730 | 120 | 20 | 758 | 982 | 16 | 19 |
| I2Kd | 450 | 700 (ICA) | 2 | | | | 870 | 1071 | 17.9 | 18 |
| I2Ve | 450 | 600 (HBA) | 900 | 740 | 120 | 20 | 734 | 1045 | 14.6 | 15 |
| I2Ke | 450 | 700 (ICA) | 2 | | | | 817 | 1098 | 16.8 | 16 |
| I4Tf | 550 | 600 (HBA) | 300 | 710 | 120 | Air | 739 | 810 | 17.3 | n.d. |
| I4Tg | 550 | 600 (HBA) | 300 | 730 | 120 | Air | 650 | 953 | 17.2 | n.d. |
| I4Ug | 550 | 700 (ICA) | 2 | | | | 733 | 955 | 21.5 | n.d. |
| I4Th | 550 | 600 (HBA) | 300 | 740 | 120 | Air | 624 | 989 | 16.9 | n.d. |

TABLE 4-continued

| Ex. | $T_{coil}$ (° C.) | TA (° C.) | $t_A$ (min) | $T_{anneal}$ (° C.) | $t_{anneal}$ (s) | Vc1 (° C./s) | YS (MPa) | TS (MPa) | UE (%) | HER (%) |
|---|---|---|---|---|---|---|---|---|---|---|
| I4Uh | 550 | 700 (ICA) | 2 | | | | 690 | 1015 | 18.2 | n.d. |
| I4Ti | 550 | 600 (HBA) | 300 | 750 | 120 | Air | 528 | 1021 | 10.5 | n.d. |
| I4Ui | 550 | 700 (ICA) | 2 | | | | 611 | 1070 | 15.4 | n.d. |
| I4Tj | 550 | 600 (HBA) | 300 | 760 | 120 | Air | 453 | 1076 | 10.6 | n.d. |
| I4Tk | 550 | 600 (HBA) | 300 | 770 | 120 | Air | 516 | 1138 | 8.7 | n.d. |
| I5Wd | 600 | 600 (HBA) | 300 | 730 | 120 | 20 | 877 | 1066 | 18.2 | 19.2 |
| I5Xd | 20 | 600 (HBA) | 300 | | | | 868 | 1063 | 17.8 | 22 |
| I5Kd | 450 | 700 (ICA) | 2 | | | | 914 | 1034 | 21.7 | 18.6 |
| I5We | 600 | 600 (HBA) | 300 | 740 | 120 | 20 | 843 | 1091 | 17.1 | 16.4 |
| I5Xe | 20 | 600 (HBA) | 300 | | | | 824 | 1078 | 16 | 19 |
| I5Ke | 450 | 700 (ICA) | 2 | | | | 807 | 1102 | 15.6 | 15.3 |
| I5Wl | 600 | 600 HBA) | 300 | 750 | 120 | 20 | 776 | 1111 | 15.3 | 17 |
| 15Xl | 20 | 600 HBA) | 300 | | | | 809 | 1100 | 18.1 | 13.4 |
| I5Kl | 450 | 700 (ICA) | 2 | | | | 849 | 1056 | 20.2 | 14 |
| I6Kb | 450 | 700 (ICA) | 2 | 710 | 240 | 25 | 778 | 1352 | 16 | nd |
| I6Fm | 450 | 700 (ICA) | 2 | 690 | 240 | 25 | 918 | 1169 | 22.3 | nd |
| I7Ka | 450 | 700 (ICA) | 2 | 730 | 240 | 25 | 844 | 1235 | 14.4 | nd |
| I7Kb | 450 | 700 (ICA) | 2 | 710 | 240 | 25 | 932 | 1105 | 19.4 | nd |

TABLE 5

| Ex. | $T_{coil}$ (° C.) | TA (° C.) | $t_A$ (min) | $T_{anneal}$ (° C.) | $t_{anneal}$ (s) | $Vc_1$ (° C./s) | TQ (° C.) | PT (° C.) | tP (s) | YS (MPa) | TS (MPa) | UE (%) | HER (%) |
|---|---|---|---|---|---|---|---|---|---|---|---|---|---|
| I3Yn | 450 | 600 (HBA) | 300 | 840 | 120 | 10 | 150 | 450 | 220 | 1216 | 1332 | 11 | 24.5 |
| I3Zo | 450 | 700 (ICA) | 10 | 770 | 120 | 10 | 40 | 450 | 220 | 1098 | 1291 | 12.3 | nd |
| I3Zp | 450 | 700 (ICA) | 10 | 830 | 120 | 10 | 90 | 450 | 220 | 1318 | 1361 | 10.8 | 26.8 |
| I3Zq | 450 | 700 (ICA) | 10 | | | | 130 | 450 | 220 | 1247 | 1356 | 11.6 | 26 |

Figure 3:
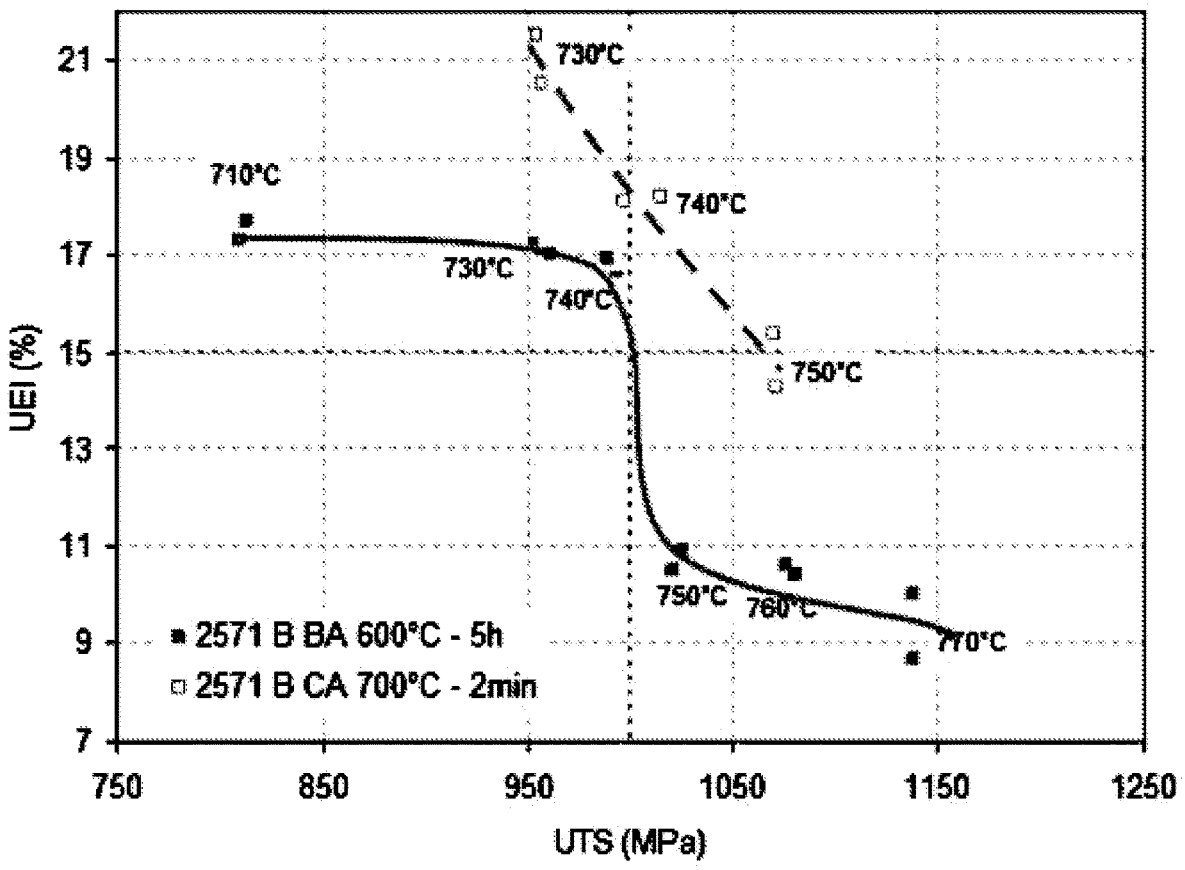
FIG. 3 is a graph comparing the mechanical properties of a cold-rolled and heat treated steel sheet produced either from a hot-rolled and batch annealed steel sheet, or from a hot-rolled and continuously steel sheet.

The properties of the examples made of steel I4 are reported on FIG. 3 (UTS designating the tensile strength and UEI designating the uniform elongation).

On this figure, each curve corresponds to an annealing condition after hot-rolling (black squares: batch annealing at 600° C. for 300 min; white squares: continuous annealing at 700° C. for 2 min), and each point of each curve reports the tensile strength and the uniform elongation obtained with a particular annealing temperature, it being understood that the higher the annealing temperature, the higher the tensile strength.

The results reported on FIG. 3 and in Table 4 demonstrate that performing the continuous annealing of the present disclosure allows achieving an improved combination of tensile strength and elongation as compared to batch annealing.

Thus, the steel sheets manufactured according to the present disclosure can be used with profit for the fabrication of structural or safety parts of vehicles.

What is claimed is:

1. A cold-rolled and heat treated steel sheet, made of a steel having a composition comprising, by weight percent:

0.1%≤C≤0.4%
3.5%≤Mn≤8.0%
0.1%≤Si≤1.5%
Al≤3%
Mo≤0.5%
Cr≤1%
Nb≤0.1%
Ti≤0.1%
V≤0.2%
B≤0.004%
0.002%≤N≤0.013%

S≤0.003%

P≤0.015%, a remainder being iron and unavoidable impurities, the cold-rolled and heat-treated steel sheet having a structure consisting of, in surface fraction:

between 8 and 50% of retained austenite;

at most 80% of intercritical ferrite, ferrite grains of the intercritical ferrite having an average size of at most 1.5 μm;

at most 1% of cementite, wherein particles of the cementite have an average size lower than 50 nm; and martensite and/or bainite.

2. The cold-rolled and heat treated steel sheet according to claim 1, wherein the retained austenite has an average C content of at least 0.4%.

3. The cold-rolled and heat treated steel sheet according to claim 1, wherein the retained austenite has an average Mn content of at least 1.3*Mn %, Mn % designating the average Mn content in the steel composition.

4. The cold-rolled and heat treated steel sheet according to claim 2, wherein the retained austenite has an average Mn content of at least 1.3*Mn %, Mn % designating the average Mn content in the steel composition.

5. The cold-rolled and heat treated steel sheet according to claim 1, wherein the structure comprises, in surface fraction, at least 10% of intercritical ferrite.

6. The cold-rolled and heat treated steel sheet according to claim 1, wherein the structure consists of, in surface fraction:

between 8 and 30% of retained austenite;

at most 1% of cementite, particles of the cementite having an average size lower than 50 nm; and martensite and/or bainite.

7. The cold-rolled and heat treated steel sheet according to claim 1, wherein the martensite consists of tempered martensite and/or fresh martensite.

8. The cold-rolled and heat treated steel sheet according to claim 7, wherein the structure consists of, in surface fraction:

between 8% and 50% of retained austenite, the retained austenite having an average C content of at least 0.4% and an average Mn content of at least 1.3*Mn %, Mn % designating the average Mn content in the steel composition;

between 40% and 80% of intercritical ferrite, ferrite grains of the intercritical ferrite having an average size of at most 1.5 μm;

at most of 15% of martensite and/or bainite; and at most 0.3% of cementite, particles of cementite having an average size lower than 50 nm.

9. The cold-rolled and heat treated steel sheet according to claim 7, wherein the structure consists of, in surface fraction:

between 8% and 30% of retained austenite, the retained austenite having an average C content of at least 0.4%;

between 70% and 92% of martensite and/or bainite; and at most 1% of cementite, particles of the cementite having an average size lower than 50 nm.

10. The cold-rolled and heat treated steel sheet according to claim 1, wherein the martensite consists of partitioned martensite and/or fresh martensite, the partitioned martensite having an average C content strictly lower than a nominal C content in the steel composition.

11. The cold-rolled and heat treated steel sheet according to claim 10, wherein the structure consists of, in surface fraction:

at most 45% of intercritical ferrite, ferrite grains of the intercritical ferrite having an average size of at most 1.5 μm;

between 8% and 30% of retained austenite;

partitioned martensite;

at most 8% of fresh martensite; and at most 1% of cementite, particles of the cementite having an average size lower than 50 nm.

12. The cold-rolled and heat treated steel sheet according to claim 11, wherein the structure consists of, in surface fraction:

between 10% and 45% of intercritical ferrite, ferrite grains of the intercritical ferrite having an average size of at most 1.5 μm;

between 8% and 30% of retained austenite;

partitioned martensite;

at most 8% of fresh martensite; and at most 0.3% of cementite, particles of the cementite having an average size lower than 50 nm.

13. The cold-rolled and heat treated steel sheet according to claim 11, wherein the structure consists of, in surface fraction:

between 8% and 30% of retained austenite;

partitioned martensite;

at most 8% of fresh martensite; and at most 1% of cementite, particles of the cementite having an average size lower than 50 nm.

* * * * *